US008944884B2

(12) United States Patent
David et al.

(10) Patent No.: US 8,944,884 B2
(45) Date of Patent: Feb. 3, 2015

(54) FITTING OF OPTICAL MODEL TO MEASURED SPECTRUM

(71) Applicants: Jeffrey Drue David, San Jose, CA (US); Dominic J. Benvegnu, La Honda, CA (US)

(72) Inventors: Jeffrey Drue David, San Jose, CA (US); Dominic J. Benvegnu, La Honda, CA (US)

(73) Assignee: Applied Materials, Inc., Santa Clara, CA (US)

( * ) Notice: Subject to any disclaimer, the term of this patent is extended or adjusted under 35 U.S.C. 154(b) by 141 days.

(21) Appl. No.: 13/773,063

(22) Filed: Feb. 21, 2013

(65) Prior Publication Data

US 2013/0237128 A1 Sep. 12, 2013

Related U.S. Application Data

(60) Provisional application No. 61/608,284, filed on Mar. 8, 2012.

(51) Int. Cl.
*B24B 1/00* (2006.01)
*B24B 37/013* (2012.01)
*B24B 49/12* (2006.01)

(52) U.S. Cl.
CPC ..... *B24B 37/013* (2013.01); *B24B 49/12* (2013.01)
USPC ..... 451/5; 451/6; 451/41; 451/11; 451/285; 451/288

(58) Field of Classification Search
CPC .... B24B 49/16; B24B 37/013; B24B 37/042; B24B 49/12; B24B 49/00
USPC ..... 451/5, 6, 11, 41, 285–290; 700/160, 700/173, 175
See application file for complete search history.

(56) References Cited

U.S. PATENT DOCUMENTS

| | | | | |
|---|---|---|---|---|
| 5,653,622 | A * | 8/1997 | Drill et al. | 451/5 |
| 5,658,183 | A * | 8/1997 | Sandhu et al. | 451/5 |
| 6,276,987 | B1 * | 8/2001 | Li et al. | 451/5 |
| 6,361,646 | B1 | 3/2002 | Bibby, Jr. et al. | |

(Continued)

FOREIGN PATENT DOCUMENTS

| | | |
|---|---|---|
| KR | 10-2011-0102376 | 9/2011 |
| KR | 10-2012-0010180 | 2/2012 |

OTHER PUBLICATIONS

International Search Report and Written Opinion in International Application No. PCT/US2013/026954, mailed Jun. 14, 2013, 14 pages.

*Primary Examiner* — George Nguyen
(74) *Attorney, Agent, or Firm* — Fish & Richardson P.C.

(57) ABSTRACT

A method of controlling a polishing operation includes polishing a first layer of a substrate, during polishing, obtaining a sequence over time of measured spectra with an in-situ optical monitoring system, for each measured spectrum from the sequence of measured spectra, fitting an optical model to the measured spectrum, the fitting including finding parameters that provide a minimum difference between an output spectrum of the optical model and the measured spectrum, the parameters including an endpoint parameter and at least one non-endpoint parameter, the fitting generating a sequence of fitted endpoint parameter values, each endpoint parameter value of the sequence associated with one of the spectra of the sequence of measured spectra, and determining at least one of a polishing endpoint or an adjustment of a pressure to the substrate from the sequence of fitted endpoint parameter values.

20 Claims, 4 Drawing Sheets

(56) References Cited

U.S. PATENT DOCUMENTS

| | | | | |
|---|---|---|---|---|
| 6,947,135 | B2 * | 9/2005 | Johnson | 356/237.2 |
| 7,018,271 | B2 * | 3/2006 | Wiswesser et al. | 451/8 |
| 7,264,535 | B2 * | 9/2007 | Guthrie et al. | 451/5 |
| 7,406,394 | B2 | 7/2008 | Swedek et al. | |
| 8,088,298 | B2 | 1/2012 | Swedek et al. | |
| 8,157,616 | B2 * | 4/2012 | Shimizu et al. | 451/8 |
| 8,202,738 | B2 * | 6/2012 | David et al. | 438/7 |
| 2001/0039064 | A1 | 11/2001 | Ushio et al. | |
| 2004/0185582 | A1 | 9/2004 | Kueny | |
| 2005/0117164 | A1 * | 6/2005 | Nomoto et al. | 356/504 |
| 2006/0252348 | A1 * | 11/2006 | Lin et al. | 451/5 |
| 2006/0274326 | A1 * | 12/2006 | Kobayashi et al. | 356/600 |
| 2007/0042675 | A1 | 2/2007 | Benvegnu et al. | |
| 2008/0099443 | A1 | 5/2008 | Benvegnu et al. | |
| 2008/0206993 | A1 | 8/2008 | Lee et al. | |
| 2010/0075576 | A1 * | 3/2010 | Kobayashi et al. | 451/5 |
| 2010/0114532 | A1 | 5/2010 | David et al. | |
| 2010/0120331 | A1 * | 5/2010 | Carlsson et al. | 451/5 |
| 2010/0129939 | A1 | 5/2010 | David | |
| 2012/0019830 | A1 | 1/2012 | Kimba | |
| 2012/0028377 | A1 | 2/2012 | David et al. | |
| 2012/0278028 | A1 | 11/2012 | David et al. | |
| 2013/0288570 | A1 * | 10/2013 | David | 451/5 |

* cited by examiner

FITTING OF OPTICAL MODEL TO MEASURED SPECTRUM

CROSS REFERENCE TO RELATED APPLICATIONS

This application claims priority to U.S. Provisional Application Ser. No. 61/608,284, filed Mar. 8, 2012, the entirety of which is incorporated by reference.

TECHNICAL FIELD

The present disclosure relates to polishing control methods, e.g., during chemical mechanical polishing of substrates.

BACKGROUND

An integrated circuit is typically formed on a substrate by the sequential deposition of conductive, semiconductive, or insulative layers on a silicon wafer. One fabrication step involves depositing a filler layer over a non-planar surface and planarizing the filler layer. For certain applications, the filler layer is planarized until the top surface of a patterned layer is exposed. A conductive filler layer, for example, can be deposited on a patterned insulative layer to fill the trenches or holes in the insulative layer. After planarization, the portions of the conductive layer remaining between the raised pattern of the insulative layer form vias, plugs, and lines that provide conductive paths between thin film circuits on the substrate. For other applications, such as oxide polishing, the filler layer is planarized until a predetermined thickness is left over the non planar surface. In addition, planarization of the substrate surface is usually required for photolithography.

Chemical mechanical polishing (CMP) is one accepted method of planarization. This planarization method typically requires that the substrate be mounted on a carrier head. The exposed surface of the substrate is typically placed against a rotating polishing pad. The carrier head provides a controllable load on the substrate to push it against the polishing pad. A polishing liquid, such as a slurry with abrasive particles, is typically supplied to the surface of the polishing pad.

One problem in CMP is determining whether the polishing process is complete, i.e., whether a substrate layer has been planarized to a desired flatness or thickness, or when a desired amount of material has been removed. Variations in the initial thickness of the substrate layer, the slurry composition, the polishing pad condition, the relative speed between the polishing pad and the substrate, and the load on the substrate can cause variations in the material removal rate. These variations cause variations in the time needed to reach the polishing endpoint. Therefore, it may not be possible to determine the polishing endpoint merely as a function of polishing time.

In some systems, a substrate is optically monitored in-situ during polishing, e.g., through a window in the polishing pad. However, existing optical monitoring techniques may not satisfy increasing demands of semiconductor device manufacturers.

SUMMARY

In some optical monitoring processes, a spectrum measured in-situ, e.g., during a polishing process of CMP, is compared to a library of reference spectra to find the best matching reference spectrum. However, the library of reference spectra may not include a spectrum that provides a good match. Alternatively, where the number of reference spectra is very large, the time required to determine the best match may become cumbersome.

An alternative technique is to fit a function, e.g., an optical model, to the measured spectrum. The optical model is a function with multiple parameters, e.g. the thickness, index of refraction and extinction coefficient of each layer in the stack. Other parameters are possible for the function, such as die pattern. The optical model generates an output spectrum based on the parameters. By fitting the optical model to the measured spectrum, the parameters are selected, e.g., by regression techniques, to provide an output spectrum that closely matches the measured spectrum. An indication of when to endpoint, e.g., the thickness of the layer being polished, can then be determined from the appropriate parameter.

In one aspect, a method of controlling a polishing operation includes polishing a first layer of a substrate, during polishing, obtaining a sequence over time of measured spectra with an in-situ optical monitoring system, for each measured spectrum from the sequence of measured spectra, fitting an optical model to the measured spectrum, the fitting including finding parameters that provide a minimum difference between an output spectrum of the optical model and the measured spectrum, the parameters including an endpoint parameter and at least one non-endpoint parameter, the fitting generating a sequence of fitted endpoint parameter values, each endpoint parameter value of the sequence associated with one of the spectra of the sequence of measured spectra, and determining at least one of a polishing endpoint or an adjustment of a pressure to the substrate from the sequence of fitted endpoint parameter values.

Implementations may include one or more of the following features. The endpoint parameter may be a thickness of the first layer. The non-endpoint parameter may include at least one of an index of refraction or an extinction coefficient of the first layer or a thickness, an index of refraction, or an extinction coefficient of a second layer underlying the first layer. The non-endpoint parameter may include the index of refraction and the extinction coefficient of the first layer. The non-endpoint parameter may include a plurality of thicknesses, each thickness of the plurality of thicknesses associated with a different layer in a stack of layers below the first layer. The minimum difference may be a sum of squares difference or a sum of absolute differences between the output spectrum and the measured spectrum. Finding parameters comprises performing a regression technique to a minima of the difference between the measured spectrum and the output spectrum generated by the optical model. The regression technique may be Levenberg-Marquardt, Fminunc( ), lsqnonlin( ) or simulated annealing. Fitting the optical model to the measured spectrum may include finding a plurality of local minima and identifying a global minima from the plurality of local minima. Finding a plurality of local minima may include genetic algorithms, running the regression techniques from multiple starting points with parallel computing, global search, or pattern searching. A linear function may be fit to the sequence of fitted endpoint parameter values, and determining the polishing endpoint may include determining where the linear function equals a target value.

Certain implementations may include one or more of the following advantages. An optical model may be fit to a measured spectrum, and an indication of when to endpoint, e.g., the thickness of a layer being polished, may be determined from the fitted parameters. In some situations, this approach may be less computationally intensive and thus performed faster than other techniques. Reliability of the endpoint system to detect a desired polishing endpoint may be improved, and within-wafer and wafer-to-wafer thickness non-uniformity (WIWNU and WTWNU) may be reduced.

BRIEF DESCRIPTION OF THE DRAWINGS

Like reference numbers and designations in the various drawings indicate like elements.

DETAILED DESCRIPTION

One optical monitoring technique is to measure spectra of light reflected from a substrate during polishing, and identify a matching reference spectra from a library. One potential problem, that the thickness, index of refraction (n) and extinction coefficient (k) values of the deposited layers used in these models vary from customer to customer and from lot to lot, depending on film composition and film deposition control. Even layers that are ostensibly of the same material composition can have n and k values that vary from substrate to substrate in the due process conditions in the deposition procedure. Due to the large number of varying parameters, creation of a library of spectra, or finding of a matching spectra within a large library, may be impractical.

To address this, a function, e.g., an optical model, can be fit to the measured spectrum. The thickness of the layer being polished can then be determined from the appropriate parameter of the optical model.

A substrate can include a first layer (that will undergo polishing) and a second layer disposed under the first layer. Both the first layer and the second layer are at least semi-transparent. Together, the second layer and one or more additional layers (if present) provide a layer stack below the first layer. Examples of layers include an insulator, passivation, etch stop, barrier layer and capping layers. Examples of materials in such layers include oxide, such as silicon dioxide, a low-k material, such as carbon doped silicon dioxide, e.g., Black Diamond™ (from Applied Materials, Inc.) or Coral™ (from Novellus Systems, Inc.), silicon nitride, silicon carbide, carbon-silicon nitride (SiCN), a metal nitride, e.g., tantalum nitride or titanium nitride, or a material formed from tetraethyl orthosilicate (TEOS).

Chemical mechanical polishing can be used to planarize the substrate until a predetermined thickness of the first layer is removed, a predetermined thickness of the first layer remains, or until the second layer is exposed.

Figure 1:
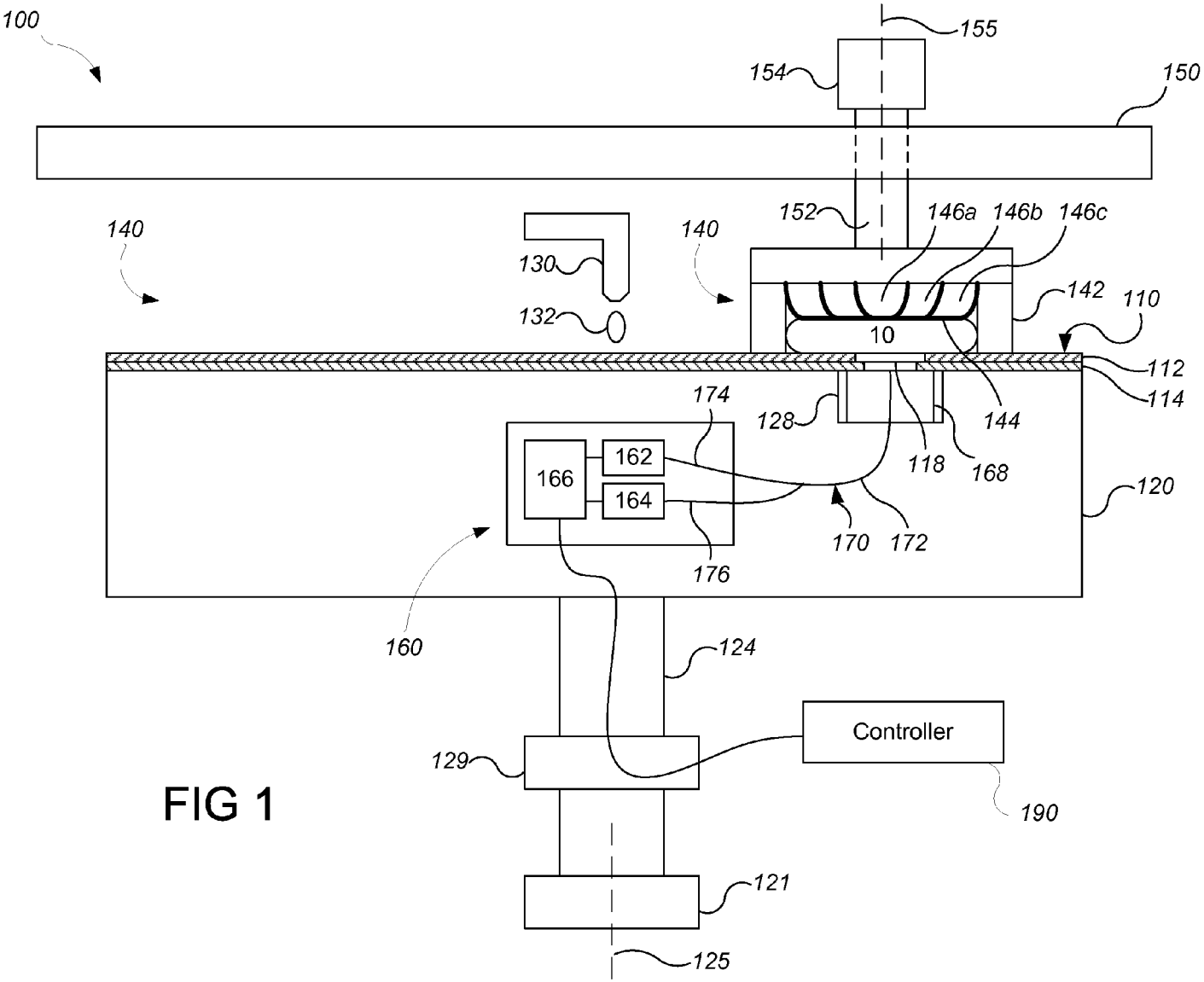
FIG. 1 illustrates a schematic cross-sectional view of an example of a polishing apparatus.

FIG. 1 illustrates an example of a polishing apparatus 100. The polishing apparatus 100 includes a rotatable disk-shaped platen 120 on which a polishing pad 110 is situated. The platen is operable to rotate about an axis 125. For example, a motor 121 can turn a drive shaft 124 to rotate the platen 120. The polishing pad 110 can be a two-layer polishing pad with an outer polishing layer 112 and a softer backing layer 114.

The polishing apparatus 100 can include a port 130 to dispense polishing liquid 132, such as a slurry, onto the polishing pad 110 to the pad. The polishing apparatus can also include a polishing pad conditioner to abrade the polishing pad 110 to maintain the polishing pad 110 in a consistent abrasive state.

The polishing apparatus 100 includes one or more carrier heads 140. Each carrier head 140 is operable to hold a substrate 10 against the polishing pad 110. Each carrier head 140 can have independent control of the polishing parameters, for example pressure, associated with each respective substrate.

Figure 2:
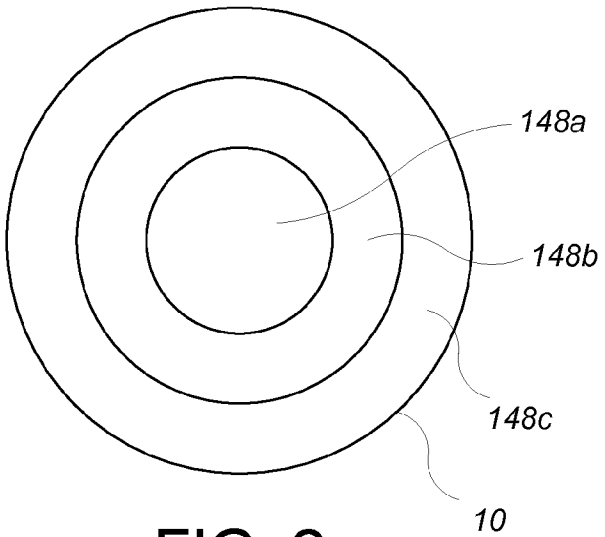
FIG. 2 illustrates a schematic top view of a substrate having multiple zones.

In particular, each carrier head 140 can include a retaining ring 142 to retain the substrate 10 below a flexible membrane 144. Each carrier head 140 also includes a plurality of independently controllable pressurizable chambers defined by the membrane, e.g., three chambers 146*a*-146*c*, which can apply independently controllable pressures to associated zones 148*a*-148*c* on the flexible membrane 144 and thus on the substrate 10 (see FIG. 3). Referring to FIG. 2, the center zone 148*a* can be substantially circular, and the remaining zones 148*b*-148*c* can be concentric annular zones around the center zone 148*a*. Although only three chambers are illustrated in FIGS. 1 and 2 for ease of illustration, there could be one or two chambers, or four or more chambers, e.g., five chambers.

Returning to FIG. 1, each carrier head 140 is suspended from a support structure 150, e.g., a carousel, and is connected by a drive shaft 152 to a carrier head rotation motor 154 so that the carrier head can rotate about an axis 155. Optionally each carrier head 140 can oscillate laterally, e.g., on sliders on the carousel 150; or by rotational oscillation of the carousel itself. In operation, the platen is rotated about its central axis 125, and each carrier head is rotated about its central axis 155 and translated laterally across the top surface of the polishing pad.

While only one carrier head 140 is shown, more carrier heads can be provided to hold additional substrates so that the surface area of polishing pad 110 may be used efficiently. Thus, the number of carrier head assemblies adapted to hold substrates for a simultaneous polishing process can be based, at least in part, on the surface area of the polishing pad 110.

The polishing apparatus also includes an in-situ optical monitoring system 160, e.g., a spectrographic monitoring system, which can be used to determine whether to adjust a polishing rate or an adjustment for the polishing rate as discussed below. An optical access through the polishing pad is provided by including an aperture (i.e., a hole that runs through the pad) or a solid window 118. The solid window 118 can be secured to the polishing pad 110, e.g., as a plug that fills an aperture in the polishing pad, e.g., is molded to or adhesively secured to the polishing pad, although in some implementations the solid window can be supported on the platen 120 and project into an aperture in the polishing pad.

The optical monitoring system 160 can include a light source 162, a light detector 164, and circuitry 166 for sending and receiving signals between a remote controller 190, e.g., a computer, and the light source 162 and light detector 164. One or more optical fibers can be used to transmit the light from the light source 162 to the optical access in the polishing pad, and to transmit light reflected from the substrate 10 to the detector 164. For example, a bifurcated optical fiber 170 can be used to transmit the light from the light source 162 to the substrate 10 and back to the detector 164. The bifurcated optical fiber can include a trunk 172 positioned in proximity to the optical access, and two branches 174 and 176 connected to the light source 162 and detector 164, respectively.

In some implementations, the top surface of the platen can include a recess 128 into which is fit an optical head 168 that holds one end of the trunk 172 of the bifurcated fiber. The optical head 168 can include a mechanism to adjust the vertical distance between the top of the trunk 172 and the solid window 118.

The output of the circuitry 166 can be a digital electronic signal that passes through a rotary coupler 129, e.g., a slip ring, in the drive shaft 124 to the controller 190 for the optical monitoring system. Similarly, the light source can be turned on or off in response to control commands in digital electronic signals that pass from the controller 190 through the rotary coupler 129 to the optical monitoring system 160. Alternatively, the circuitry 166 could communicate with the controller 190 by a wireless signal.

The light source 162 can be operable to emit white light. In one implementation, the white light emitted includes light having wavelengths of 200-800 nanometers. A suitable light source is a xenon lamp or a xenon mercury lamp.

Figure 4:
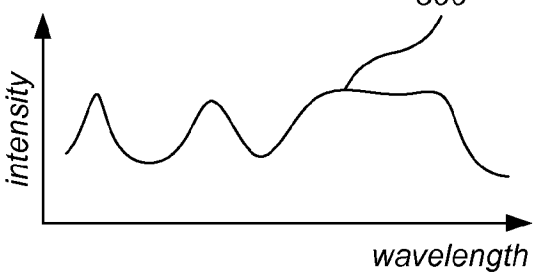
FIG. 4 illustrates a measured spectrum from the in-situ optical monitoring system.
Figure 5:
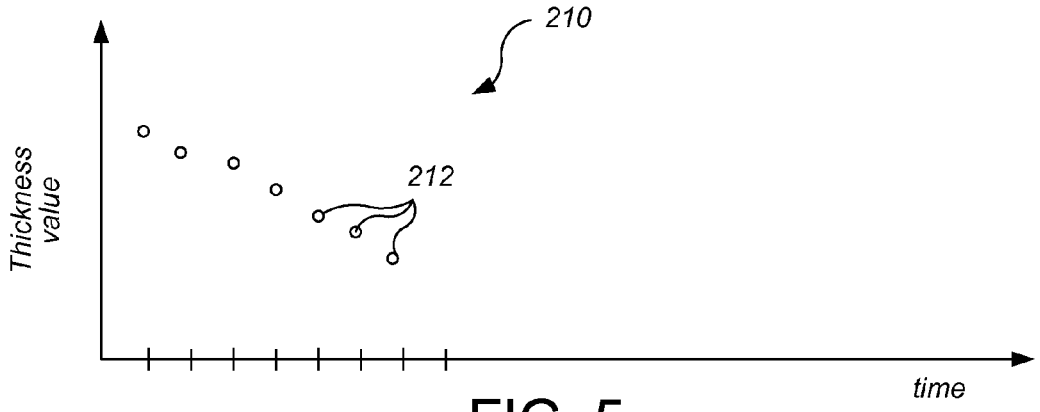
FIG. 5 illustrates an index trace.

The light detector 164 can be a spectrometer. A spectrometer is an optical instrument for measuring intensity of light over a portion of the electromagnetic spectrum. A suitable spectrometer is a grating spectrometer. Typical output for a spectrometer is the intensity of the light as a function of wavelength (or frequency). FIG. 4 illustrates an example of a measured spectrum 300.

As noted above, the light source 162 and light detector 164 can be connected to a computing device, e.g., the controller 190, operable to control their operation and receive their signals. The computing device can include a microprocessor situated near the polishing apparatus, e.g., a programmable computer. With respect to control, the computing device can, for example, synchronize activation of the light source with the rotation of the platen 120.

In some implementations, the light source 162 and detector 164 of the in-situ monitoring system 160 are installed in and rotate with the platen 120. In this case, the motion of the platen will cause the sensor to scan across each substrate. In particular, as the platen 120 rotates, the controller 190 can cause the light source 162 to emit a series of flashes starting just before and ending just after the optical access passes below the substrate 10. Alternatively, the computing device can cause the light source 162 to emit light continuously starting just before and ending just after each substrate 10 passes over the optical access. In either case, the signal from the detector can be integrated over a sampling period to generate spectra measurements at a sampling frequency.

In operation, the controller 190 can receive, for example, a signal that carries information describing a spectrum of the light received by the light detector for a particular flash of the light source or time frame of the detector. Thus, this spectrum is a spectrum measured in-situ during polishing.

Figure 3:
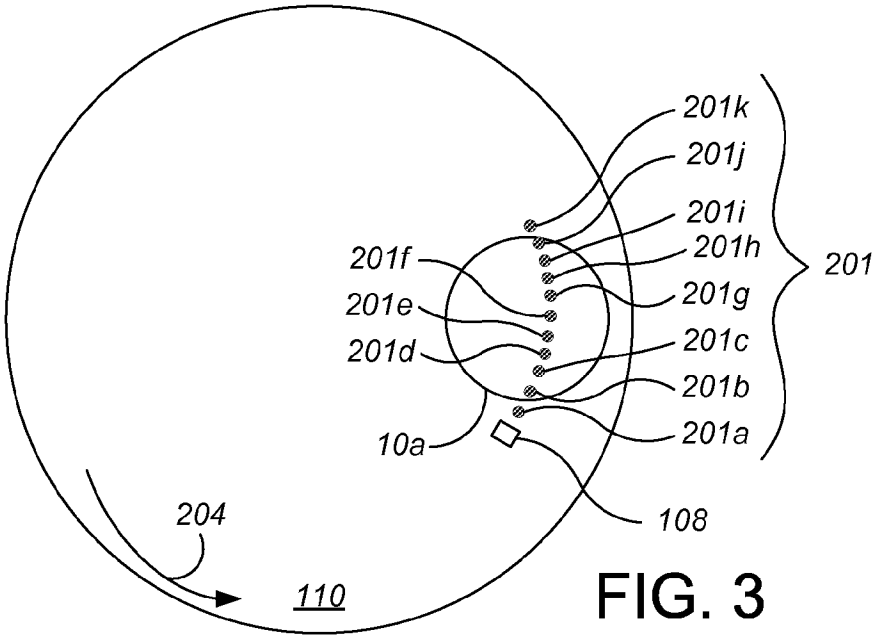
FIG. 3 illustrates a top view of a polishing pad and shows locations where in-situ measurements are taken on a substrate.

As shown by in FIG. 3, if the detector is installed in the platen, due to the rotation of the platen (shown by arrow 204), as the window 108 travels below a carrier head, the optical monitoring system making spectra measurements at a sampling frequency will cause the spectra measurements to be taken at locations 201 in an arc that traverses the substrate 10. For example, each of points 201*a*-201*k* represents a location of a spectrum measurement by the monitoring system (the number of points is illustrative; more or fewer measurements can be taken than illustrated, depending on the sampling frequency). The sampling frequency can be selected so that between five and twenty spectra are collected per sweep of the window 108. For example, the sampling period can be between 3 and 100 milliseconds.

As shown, over one rotation of the platen, spectra are obtained from different radii on the substrate 10. That is, some spectra are obtained from locations closer to the center of the substrate 10 and some are closer to the edge. Thus, for any given scan of the optical monitoring system across a substrate, based on timing, motor encoder information, and optical detection of the edge of the substrate and/or retaining ring, the controller 190 can calculate the radial position (relative to the center of the substrate being scanned) for each measured spectrum from the scan. The polishing system can also include a rotary position sensor, e.g., a flange attached to an edge of the platen that will pass through a stationary optical interrupter, to provide additional data for determination of which substrate and the position on the substrate of the measured spectrum. The controller can thus associate the various measured spectra with the controllable zones 148*b*-148*e* (see FIG. 2) on the substrates 10*a* and 10*b*. In some implementations, the time of measurement of the spectrum can be used as a substitute for the exact calculation of the radial position.

Over multiple rotations of the platen, for each zone, a sequence of spectra can be obtained over time. Without being limited to any particular theory, the spectrum of light reflected from the substrate 10 evolves as polishing progresses (e.g., over multiple rotations of the platen, not during a single sweep across the substrate) due to changes in the thickness of the outermost layer, thus yielding a sequence of time-varying spectra. Moreover, particular spectra are exhibited by particular thicknesses of the layer stack.

The controller, e.g., the computing device, can be programmed to fit a function, e.g., an optical model, to the measured spectrum. The function has multiple input parameters, and that generates an output spectrum calculated from the input parameters. The input parameters include at least a value from which the polishing endpoint can readily be determined, e.g., the thickness of the first layer. However, the parameter could also be a thickness removed, or more generic representation of the progress of the substrate through the polishing process, e.g., an index value representing the time or number of platen rotations at which the spectrum would be expected to be observed in a polishing process that follows a predetermined progress. The input parameter can also include the index of refraction and extinction coefficient of the first layer. The input parameters can also include the thickness, index of refraction and extinction coefficient of one or more layers in the stack.

As an example of an optical model to calculate an output spectrum, the reflectance $R_{STACK}$ of the top layer p of a thin film stack can be calculated as $$R_{STACK} = \left|\frac{E_p^-}{E_p^+}\right|^2$$

where $E_p^+$ represents the electro-magnetic field strength of the incoming light beam and $E_p^-$ represents the electromagnetic field strength of the outgoing light beam.

The values $E_p^+$ and $E_p^-$ can be calculated as $$E_p^+=(E_p+H_p/\mu_p)/2$$

$$E_p^-=(E_p-H_p/\mu_p)/2$$

The fields E and H in an arbitrary layer j can be calculated using transfer-matrix methods from the fields E and H in an underlying layer. Thus, in a stack of layers 0, 1, . . . , p−1, p (where layer 0 is the bottom layer and layer p is the outermost layer), for a given layer j>0, $E_j$ and $H_j$ can be calculated as $$\begin{bmatrix} E_j \\ H_j \end{bmatrix} = \begin{bmatrix} \cos g_j & \frac{i}{u_j}\sin g_j \\ i\mu_j \sin g_j & \cos g_j \end{bmatrix} \begin{bmatrix} E_{j-1} \\ H_{j-1} \end{bmatrix}$$

with $\mu_j=(n_j-ik_j)\cdot\cos\phi_j$ and $g_j=2\pi(n_j-ik_j)\cdot t_j\cdot\cos\phi_j/\lambda$, where $n_j$ is the index of refraction of layer j, $k_j$ is an extinction coefficient of layer j, $\cdot t_j$ is the thickness of layer j, $\phi_j$ is the incidence angle of the light to layer j, and $\lambda$ is the wavelength. For the bottom layer in the stack, i.e., layer j=0, $E_0=1$ and $H_0=\mu_0=(n_0-ik_0)\cdot\cos\phi_0$. The incidence angle $\phi$ can be calculated from Snell's law. It should be understood that each of $R_{STACK}$, $E_j$ and $H_j$ are a function of wavelength, and that $n_j$ and $k_j$ may also be a function of wavelength.

As noted above, the thickness, index of refraction (n) and extinction coefficient (k) is a parameter that can vary. Thus, as the number of layers p increases, the number of parameters also increases.

Some boundary conditions can be imposed on the parameters. For example, the thickness t for a layer j can be permitted to vary between a minimum value $T_{MINj}$ and a maximum value $T_{MAXj}$. Similar boundary conditions can be imposed on the index of refraction (n) and extinction coefficient (k). The boundary values can be input by the operator based on knowledge of variation within the fabrication process.

In fitting the optical model to the measured spectrum, the parameters are selected to provide an output spectrum that is a close match to the measured spectrum. A close match can be considered to be the calculation of a minimum difference between the output spectrum and the measured spectrum, given the available computational power and time constraints. The thickness of the layer being polished can then be determined from the thickness parameter.

Calculation of a difference between the output spectrum and the measured spectrum can be a sum of absolute differences between the measured spectrum and the output spectrum across the spectra, or a sum of squared differences between the measured spectrum and the reference spectrum. Other techniques for calculating the difference are possible, e.g. a cross-correlation between the measured spectrum and the output spectrum can be calculated.

Fitting the parameters to find the closest output spectrum can be considered an example of finding a global minima of a function (the difference between the measured spectrum and the output spectrum generated by the function) in a multidimensional parameter space (with the parameters being the variable values in the function). For example, where the function is an optical model, the parameters can include the thickness, the index of refraction (n) and extinction coefficient (k) of the layers.

Regression techniques can be used to optimize the parameters to find a local minimum in the function. Examples of regression techniques include Levenberg-Marquardt (L-M)—which utilizes a combination of Gradient Descent and Gauss-Newton; Fminunc( )—a matlab function; lsqnonlin( )—matlab function that uses the L-M algorithm; and simulated annealing. In addition, non-regression techniques, such as the simplex method, can be used to optimize the parameters.

A potential problem with using regression or non-regression techniques alone to fine a minimum is that there may be multiple local minima in the function. If regression is commenced near the a local minima that is not the global minima, then the wrong solution may be determined as regression techniques will only go "downhill" to the best solution. However, if multiple local minima are identified, regression could be performed on all of these minima and the best solution would be identified by the one with the least difference. An alternative approach would be to track all solutions from all local minima over a period of time, and determine which is the best one over time. Examples of techniques to identify global minima include genetic algorithms; multi-start (running the regression techniques from multiple starting points with parallel computing); global search—a Matlab function; and pattern searching.

The output of fitting process is a set of fitted parameters, including at least the parameters which the polishing endpoint can readily be determined, e.g., the thickness parameter of the layer being polished. However, as noted above, the fitted parameter could also be an index value representing the time or number of platen rotations at which the spectrum would be expected to be observed in a polishing process that follows a predetermined progress.

In some implementations, the function is fit to each spectra in the sequence, thereby generating a sequence of fitted parameter values, e.g., a sequence of fitted thickness values. Now referring to FIG. 7, which illustrates the results for only a single zone of a single substrate, the sequence of fitted parameter values, e.g., thickness values, generated by fitting the function to the sequence measured spectra generates a time-varying sequence of thickness values 212. This sequence of parameter values can be termed a trace 210. In general, the trace 210 can include one, e.g., exactly one, parameter value per sweep of the optical monitoring system below the substrate.

Figure 6:
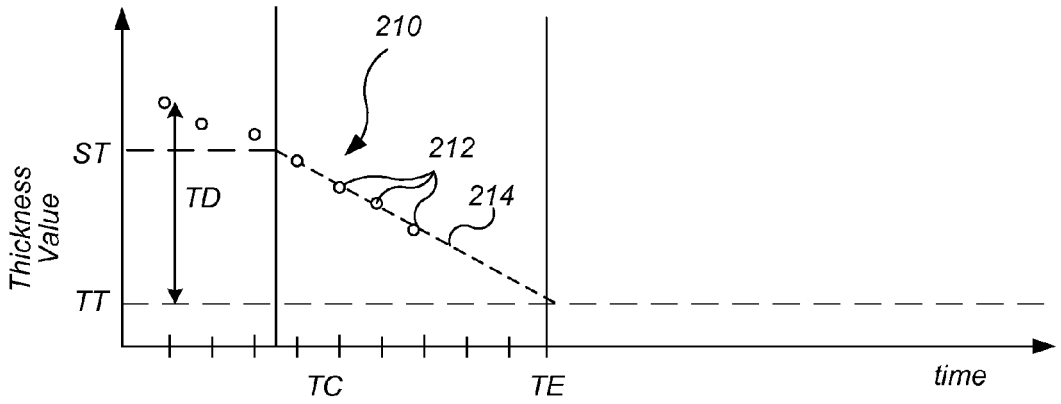
FIG. 6 illustrates an index trace having a linear function fit to index values collected after clearance of an overlying layer is detected.

As shown in FIG. 6, a function, e.g., a polynomial function of known order, e.g., a first-order function (e.g., a line 214) is fit to the sequence of parameter values of measured spectra, e.g., using robust line fitting. Other functions can be used, e.g., polynomial functions of second-order, but a line provides ease of computation.

Optionally, the function can be fit to the parameter values collected after time a TC. Parameter values for spectra collected before the time TC can ignored when fitting the function to the sequence of parameter values. This can assist in elimination of noise in the measured spectra that can occur early in the polishing process, or it can remove spectra measured during polishing of another layer. Polishing can be halted at an endpoint time TE that the line 214 crosses a target thickness TT.

Figure 7:
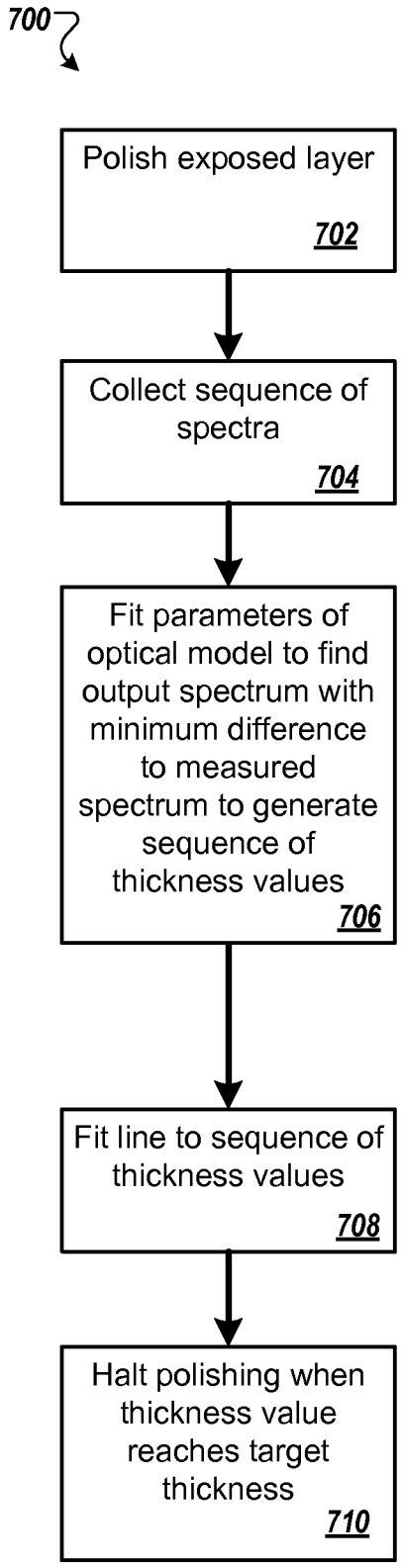
FIG. 7 is a flow diagram of an example process for controlling a polishing operation.

FIG. 7 shows a flow chart of a method 700 of polishing a product substrate. The product substrate can have at least the same layer structure as what is represented in the optical model.

The product substrate is polished (step 702), and a sequence of measured spectra are obtained during polishing (step 704), e.g., using the in-situ monitoring system described above. There may be a variety of preliminary polishing steps prior to obtaining the sequence of measured spectra. For example, one or more overlying layers can be removed, e.g., a conductive layer or dielectric layer, and measuring of the spectra can be triggered when removal of the overlying layer and clearance of the first layer is detected. For example, exposure of the first layer at a time TC (see FIG. 6) can be detected by a sudden change in the motor torque or total intensity of light reflected from the substrate, or from dispersion of the collected spectra.

The parameters of the optical model are fitted to each measured spectrum from the sequence to generate an output spectrum with minimal difference to the measured spectrum, thereby generating a sequence of thickness values (step 706). A function, e.g., a linear function, is fit to the sequence of thickness values for the measured spectra (step 708).

Polishing can be halted once the endpoint value (e.g., a calculated parameter value, e.g., a thickness value, generated from the linear function fit to the sequence of parameter values) reaches a target value (step 710). For example, in the context of thickness as the endpoint parameter, the time at which the linear function will equal the target thickness can be calculated. The target thickness TT can be set by the user prior to the polishing operation and stored. Alternatively, a target amount to remove can be set by the user, and a target thickness TT can be calculated from the target amount to remove. For example, a thickness difference TD can be calculated from the target amount to remove, e.g., from an empirically determined ratio of amount removed to the index (e.g., the polishing rate), and adding the thickness difference TD to the starting thickness ST at the time TC that clearance of the overlying layer is detected (see FIG. 6).

It is also possible to use sequences of thickness values from different zones of the substrate to adjust the pressure applied in the chambers of the carrier head to provide more uniform polishing, e.g., using techniques described in U.S. application Ser. No. 13/096,777, incorporated herein by reference (in general, the thickness value can be substituted for the index value to use similar techniques). In some implementations, the sequence of thickness values is used to adjust the polishing rate of one or more zones of a substrate, but another in-situ monitoring system or technique is used to detect the polishing endpoint.

In addition, although the discussion above assumes a rotating platen with an optical endpoint monitor installed in the platen, system could be applicable to other types of relative motion between the monitoring system and the substrate. For example, in some implementations, e.g., orbital motion, the light source traverses different positions on the substrate, but does not cross the edge of the substrate. In such cases, the collected spectra can still be grouped, e.g., spectra can be collected at a certain frequency and spectra collected within a time period can be considered part of a group. The time period should be sufficiently long that five to twenty spectra are collected for each group.

As used in the instant specification, the term substrate can include, for example, a product substrate (e.g., which includes multiple memory or processor dies), a test substrate, a bare substrate, and a gating substrate. The substrate can be at various stages of integrated circuit fabrication, e.g., the substrate can be a bare wafer, or it can include one or more deposited and/or patterned layers. The term substrate can include circular disks and rectangular sheets.

Embodiments of the invention and all of the functional operations described in this specification can be implemented in digital electronic circuitry, or in computer software, firmware, or hardware, including the structural means disclosed in this specification and structural equivalents thereof, or in combinations of them. Embodiments of the invention can be implemented as one or more computer program products, i.e., one or more computer programs tangibly embodied in a non-transitory machine readable storage media, for execution by, or to control the operation of, data processing apparatus, e.g., a programmable processor, a computer, or multiple processors or computers.

The above described polishing apparatus and methods can be applied in a variety of polishing systems. Either the polishing pad, or the carrier heads, or both can move to provide relative motion between the polishing surface and the substrate. For example, the platen may orbit rather than rotate. The polishing pad can be a circular (or some other shape) pad secured to the platen. Some aspects of the endpoint detection system may be applicable to linear polishing systems, e.g., where the polishing pad is a continuous or a reel-to-reel belt that moves linearly. The polishing layer can be a standard (for example, polyurethane with or without fillers) polishing material, a soft material, or a fixed-abrasive material. Terms of relative positioning are used; it should be understood that the polishing surface and substrate can be held in a vertical orientation or some other orientation.

Particular embodiments of the invention have been described. Other embodiments are within the scope of the following claims.

What is claimed is:

1. A method of controlling a polishing operation, comprising:

polishing a first layer of a substrate in a chemical mechanical polishing system;

obtaining a measured spectrum with an optical monitoring system positioned in the chemical mechanical polishing system;

fitting an optical model to the measured spectrum, the fitting including finding parameter values of parameters that provide a minimum of a difference between an output spectrum of the optical model and the measured spectrum, the parameters including an endpoint parameter and at least one non-endpoint parameter, the fitting generating a fitted endpoint parameter value and a fitted non-endpoint parameter value; and determining at least one of a polishing endpoint or an adjustment of a pressure for the chemical mechanical polishing system from the fitted endpoint parameter value.

2. The method of claim 1, wherein the endpoint parameter comprises a thickness of the first layer.

3. The method of claim 2, wherein the non-endpoint parameter comprises at least one of an index of refraction or an extinction coefficient of the first layer or a thickness, an index of refraction, or an extinction coefficient of a second layer underlying the first layer.

4. The method of claim 3, wherein the non-endpoint parameter comprises the index of refraction and the extinction coefficient of the first layer.

5. The method of claim 3, wherein the non-endpoint parameter comprises a plurality of thicknesses, each thickness of the plurality of thicknesses associated with a different layer in a stack of layers below the first layer.

6. The method of claim 1, wherein finding the parameter values comprises performing a regression technique to minima of the difference between the measured spectrum and the output spectrum generated by the optical model.

7. The method of claim 6, wherein the regression technique comprises Levenberg-Marquardt, Fminunc( ), lsqnonlin( ) or simulated annealing.

8. The method of claim 1, wherein fitting the optical model to the measured spectrum comprises finding a plurality of local minima and identifying a global minima from the plurality of local minima.

9. The method of claim 8, wherein finding the plurality of local minima comprises genetic algorithms, running the regression techniques from multiple starting points with parallel computing, global search, or pattern searching.

10. A method of controlling a polishing operation, comprising:

polishing a first layer of a substrate;

during polishing, obtaining a sequence over time of measured spectra with an in-situ optical monitoring system;

for each measured spectrum from the sequence of measured spectra, fitting an optical model to the measured spectrum, the fitting including finding parameter values of parameters that provide a minimum of a difference between an output spectrum of the optical model and the measured spectrum, the parameters including an endpoint parameter and at least one non-endpoint parameter, the fitting generating a sequence of fitted endpoint parameter values, each endpoint parameter value of the sequence of fitted endpoint parameter values associated with one of the spectra of the sequence of measured spectra; and determining at least one of a polishing endpoint or an adjustment of a pressure to the substrate from the sequence of fitted endpoint parameter values.

11. The method of claim 10, wherein the endpoint parameter comprises a thickness of the first layer.

12. The method of claim 11, wherein the non-endpoint parameter comprises at least one of an index of refraction or an extinction coefficient of the first layer or a thickness, an index of refraction, or an extinction coefficient of a second layer underlying the first layer.

13. The method of claim 12, wherein the non-endpoint parameter comprises the index of refraction and the extinction coefficient of the first layer.

14. The method of claim 12, wherein the non-endpoint parameter comprises a plurality of thicknesses, each thickness of the plurality of thicknesses associated with a different layer in a stack of layers below the first layer.

15. The method of claim 10, wherein the difference comprises a sum of squares difference between the output spectrum and the measured spectrum or a sum of absolute differences between the output spectrum and the measured spectrum.

16. The method of claim 10, wherein finding the parameter values comprises performing a regression technique to minima of the difference between the measured spectrum and the output spectrum generated by the optical model.

17. The method of claim 16, wherein the regression technique comprises Levenberg-Marquardt, Fminunc( ), lsqnonlin( ) or simulated annealing.

18. The method of claim 10, wherein fitting the optical model to the measured spectrum comprises finding a plurality of local minima and identifying a global minima from the plurality of local minima.

19. The method of claim 18, wherein finding the plurality of local minima comprises genetic algorithms, running the regression techniques from multiple starting points with parallel computing, global search, or pattern searching.

20. The method of claim 10, comprising fitting a linear function to the sequence of fitted endpoint parameter values, and wherein determining the polishing endpoint comprises determining where the linear function equals a target value.

* * * * *